US006073643A

United States Patent [19]

Zheng

[11] Patent Number: 6,073,643

[45] Date of Patent: Jun. 13, 2000

[54] ADJUSTABLE COLLAPSIBLE PANELS

[75] Inventor: Yu Zheng, Covina, Calif.

[73] Assignee: Patent Category Corp., Walnut, Calif.

[21] Appl. No.: 09/152,755

[22] Filed: Sep. 14, 1998

[51] Int. Cl.[7] ..... E04H 15/40

[52] U.S. Cl. ..... 135/125; 135/128; 135/144; 135/147; 52/63; 52/71

[58] Field of Search ..... 52/63, 65, 71, 52/222; 135/97, 117, 125, 128, 130, 137, 144, 147

[56] References Cited

U.S. PATENT DOCUMENTS

| | | | |
|---|---|---|---|
| 5,301,705 | 4/1994 | Zheng | 135/125 X |
| 5,385,165 | 1/1995 | Hazinski et al. | 135/115 X |
| 5,560,385 | 10/1996 | Zheng . | |
| 5,664,596 | 9/1997 | Zheng | 135/97 X |
| 5,722,446 | 3/1998 | Zheng . | |
| 5,778,915 | 7/1988 | Zheng | 135/125 X |
| 5,816,279 | 10/1998 | Zheng | 135/97 X |
| 5,816,954 | 10/1998 | Zheng | 135/125 X |
| 5,941,265 | 8/1999 | Zheng | 135/125 |

*Primary Examiner*—Carl D. Friedman
*Assistant Examiner*—Kevin D. Wilkens
*Attorney, Agent, or Firm*—Raymond Sun

[57] ABSTRACT

Collapsible structures include at least first and second panels, each panel having a foldable frame member that has a folded and an unfolded orientation, and a material covering portions of the frame member when the frame member is in the unfolded orientation, with the material assuming the unfolded orientation of its associated frame member. The first panel has a first retaining mechanism that defines an adjustment space, and the second panel has a second retaining mechanism that is movably received inside the adjustment space of the first retaining mechanism to couple the second panel to the first panel. The second retaining mechanism is movable within the adjustment space to allow the relative positions of the first and second panels to be adjusted.

16 Claims, 12 Drawing Sheets

ADJUSTABLE COLLAPSIBLE PANELS

BACKGROUND OF THE INVENTION

1. Field of the Invention

The present invention relates to collapsible structures, and in particular, to collapsible structures having panels whose position with respect to adjacent panels can be adjusted.

2. Description of the Prior Art

Collapsible objects have recently become popular with both adults and children. Examples of such collapsible objects are shown and described in U.S. Pat. Nos. 5,467,794 (Zheng) and 5,560,385 (Zheng) in the form of collapsible structures. These structures have a plurality of panels which may be twisted and folded to reduce the overall size of the structures to facilitate convenient storage and use. As such, these structures are being enjoyed by many people in many different applications.

For example, these structures have been provided in many different shapes and sizes for children's play inside and outside the house. Smaller versions of these structures have been used as infant nurseries. Even smaller versions of these structures have been used as dollhouses and action figure play houses by toddlers and children.

As another example, these structures have been made into tents or outdoor structures that can be used by adults and children for camping or other outdoor purposes. These structures have also been popular as beach cabanas.

Even animals can enjoy these structures. Some of these structures have been made into shelters that can be used by pets, both inside and outside the house.

The wide-ranging uses for these collapsible structures can be attributed to the performance, convenience and variety that these structures provide. When fully expanded, these structures are stable and can be used as a true shelter without the fear of collapse. These structures are easily twisted and folded into a compact configuration to allow the user to conveniently store the structure. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

Another example of a collapsible structure include collapsible sunshields, such as illustrated in U.S. Pat. No. 4,815,784 (Zheng). These sunshields have two interconnecting panels that span the width of the windscreen.

All of the above-mentioned collapsible structures have two or more panels, each of which is hingedly or otherwise coupled to one or more adjacent panels. While these collapsible structures enjoy the numerous benefits described above, their size and configuration are generally fixed and cannot be adjusted. For example, the collapsible structure shown in FIG. 1 of U.S. Pat. No. 5,560,385 has a top fabric that is attached to the four panels, and which cannot be removed without cutting or otherwise destroying the top fabric. As another example, the sunshield shown in FIG. 1 of U.S. Pat. No. 4,815,784 has a predetermined width, with the interconnecting fabric providing a small amount of slack to adjust the width of the sunshield. However, the width cannot be made longer or shorter to adapt the sunshield to be fitted against windscreens of varying sizes.

Thus, there still remains a need to provide collapsible objects and structures having multiple panels, where the positions of these panels can be adjusted with respect to each other, to increase the variety of play and the useful applications of these objects and structures.

SUMMARY OF THE DISCLOSURE

It is an object of the present invention to provide a collapsible structure or object having at least two panels whose positions with respect to each other can be adjusted.

It is another object of the present invention to provide a collapsible sunshield or divider, having at least two panels, whose overall width or length can be adjusted.

It is a further object of the present invention to provide a collapsible structure having at least two panels, where the position of one of the panels can be adjusted with respect to the other panels to provide increased variety in use.

In order to accomplish the objects of the present invention, the collapsible structures according to the present invention have at least first and second panels, each panel having a foldable frame member that has a folded and an unfolded orientation, and a material covering portions of the frame member when the frame member is in the unfolded orientation, with the material assuming the unfolded orientation of its associated frame member. The first panel has a first retaining mechanism that defines an adjustment space, and the second panel has a second retaining mechanism that is movably received inside the adjustment space of the first retaining mechanism to couple the second panel to the first panel. The second retaining mechanism movable within the adjustment space to allow the relative positions of the first and second panels to be adjusted.

The collapsible structures according to the present invention is convenient for use since they can be easily and quickly folded and collapsed into a smaller size for transportation and storage. More importantly, the panels that have interengaging and corresponding adjustable retaining mechanisms that function both to couple the panels to each other, and to allow relative positions of the panels to be adjusted to change the size and configuration of the object or structure. This increases the number of applications in which the collapsible objects and structures can be used, and adds to the fun and variety of these objects and structures.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides collapsible objects and structures having at least two panels whose positions with respect to each other can be adjusted. The principles of the present invention can be applied to collapsible objects and structures such as, but not limited to, sunshields, dividers, partitions, play structures, shelters, tents, cabanas, displays, cabinets, or the like.

Figure 1:
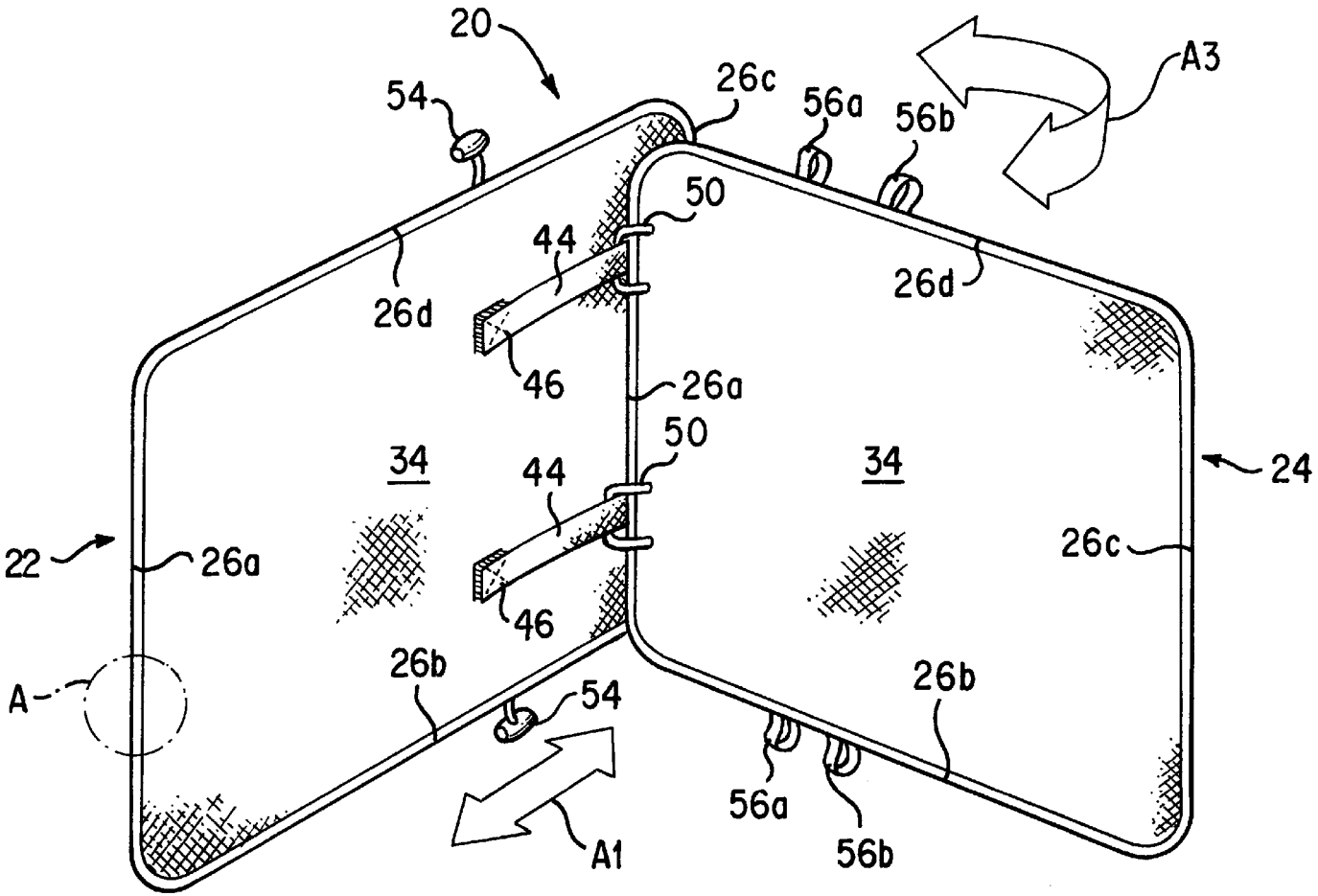
FIG. 1 is a perspective view of a collapsible object according to one embodiment of the present invention shown in use in its expanded configuration.
Figure 2:
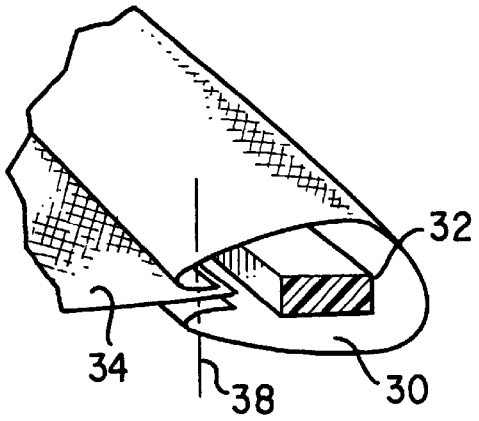
FIG. 2 is a partial cut-away view of the section A of the object of FIG. 1 illustrating a frame member retained within a sleeve.

FIGS. 1 and 2 illustrate a collapsible object 20 that embodies the underlying principles of the present invention. Referring to FIG. 1, the object 20 has two separate panels 22 and 24 that are coupled together by the adjustable attachment mechanisms (described below) of the present invention. The panels 22 and 24 can assume any configuration, such as circular, oval, rectangular (as shown), square, trapezoidal, or irregular. The panel 22 has four side edges, a left side edge 26*a*, a bottom side edge 26*b*, a right side edge 26*c*, and a top side edge 26*d*. Referring also to FIG. 2, the panel 22 has a continuous frame retaining sleeve 30 provided along and traversing the four edges of its four sides. A continuous frame member 32 is retained or held within the frame retaining sleeve 30 to support panel 22. The panel 24 can have the same structure as panel 22.

The continuous frame member 32 of each panel 22, 24 may be provided as one continuous loop, or may be a strip of material connected at both ends to form a continuous loop. The frame members 32 are preferably formed of flexible coilable steel, although other materials such as plastics may also be used. The frame members 32 should be made of a material which is relatively strong and yet is flexible to a sufficient degree to allow it to be coiled. Thus, each frame member 32 is capable of assuming two positions, an open or expanded position such as shown in FIG. 1, or a folded position in which the frame member is collapsed into a size which is much smaller than its open position (see FIG. 5D).

The frame members 32 may be merely retained within the respective frame retaining sleeve 30 without being connected thereto. Alternatively, the frame retaining sleeves 30 may be mechanically fastened, stitched, fused, or glued to the respective frame members 32 to retain them in position.

Fabric or sheet material 34 extends across each panel 22, 24, and is held taut by the respective frame members 32 when each panel is in its open position. The term fabric is to be given its broadest meaning and should be made from strong, lightweight materials and may include woven fabrics, sheet fabrics or even films. The type of fabric used will depend on the intended application. For example, a stronger and more durable fabric will be used if the structure is intended for use as a divider, or when used for the collapsible structures described in connection with FIGS. 6–8 below. Alternatively, when the object 20 is used as a sunshield, the fabric can be a sheet material having a reflective surface on one side to reflect heat and sunlight. The fabric should be water-resistant and durable to withstand the wear and tear associated with rugged outdoor use or rough treatment by children and adults.

As illustrated best in FIG. 2, the frame retaining sleeve 30 may be attached to the fabric material 34 along the side edges 26*a*–26*d* of the panels 22, 24. Specifically, the fabric material 34 can be attached to the frame retaining sleeve 30 by applying a stitching 38 that extends along the side edges 26*a*–26*d*. The stitching 38 can also operate to enclose the frame retaining sleeve 30. Alternatively, the frame retaining sleeve 30 can be a part of or an extension of the fabric material 34, where the side edge of the fabric material 34 is wrapped around the frame member 32 to enclose the frame member 32, and then the stitching 38 applied to enclose the sleeve 30.

The panels 22, 24 are provided with interacting (i.e., inter-engaging) and corresponding adjustable attachment mechanisms that function both to couple or attach the panels 22, 24 to each other, and to allow relative positions of the panels 22, 24 to be adjusted to change the size and configuration of the object 20. Specifically, the panel 22 has one or more elongated straps 44, each having opposite ends 46 and 48 (see FIG. 4) that are stitched, sewn or otherwise attached to the fabric material 34 of the panel 22. The panel 24 has one or more corresponding loops 50 that are sewn or otherwise attached to the fabric material 34 of the panel 24. Each loop 50 is held inside the space (also referred to as "adjustment space", between its corresponding strap 44 and the fabric material 34 of the panel 22, and is adapted to slide along the length of the strap 44 between the opposite ends 46 and 48 along the adjustment space between the strap 44 and the fabric material 34, as shown by arrow A1 in FIG. 1. Even though two sets of straps 44 and loops 50 are used in the object 20, any number of corresponding straps 44 and loops 50 can be provided, and even one set may be sufficient depending upon the intended application.

The straps 44 can be attached anywhere on the fabric material 34 of the panel 22, but the corresponding loops 50 should be attached to locations on the fabric material 34 of the panel 24 adjacent one of the four side edges 26*a*–26*d* to allow the panels 22, 24 to be hinged and connected. For example, in FIG. 1, the straps 44 are shown as being attached adjacent the right side edge 26*c* of the panel 22 (and spaced apart between the top and bottom side edges 26*d* and 26*b*, respectively), and the loops 50 are shown as being attached adjacent the left side edge 26*a* of the panel 24 so that the panels 22, 24 are coupled adjacent these side edges 26*c* and 26*a*, respectively.

Figure 3A:
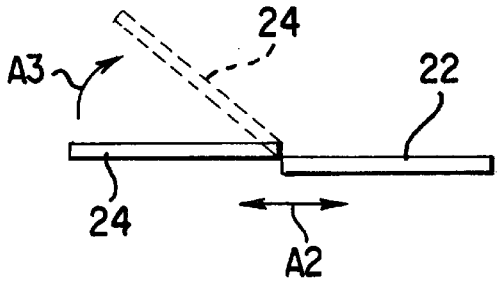
FIGS. 3A and 3B are top plan views of the object of FIG. 1 shown in use in different positions.
Figure 3B:
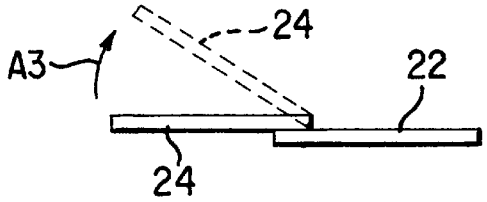

FIGS. 3A and 3B illustrate how the adjustable attachment mechanisms allow the respective positions of the panels 22, 24, and the width of the object 20, to be adjusted. In FIG. 3A, the panels 22, 24 are shown in their expanded positions and extending at the largest width of the object 20 with the right side edge 26*c* of the panel 22 and the left side edge 26*a* of the panel 24 adjacent each other and not overlapping with each other. When in this position, the loops 50 of panel 24 are adjacent the outermost end 48 of the straps 44 of panel 22. In addition, as shown in FIG. 1 and in phantom in FIG. 3A, the panel 24 may be folded or pivoted about the hinge (see arrow A3) defined by the adjustable attachment mechanisms (i.e., loops 50 and straps 44) to be placed on top of the panel 22 to form a stack of two panels 22, 24.

FIG. 3A also shows that the panels 22 and 24 can be slid with respect to each other (see arrow A2) to vary the width of the object 20. This sliding can be accomplished in many ways. For example, the panels 22, 24 can be slid with respect to each other when both panels 22, 24 are generally parallel to each other (see solid lines in FIG. 3A). Or one panel 24 can be raised at an angle with respect to the other panel 22 (see FIG. 1 and phantom in FIG. 3A) and then the panels 22, 24 slid with respect to each other. Or both panels 22, 24 can be simultaneously slid with respect to each other, or one panel 24 can be slid while the other panel 22 remains stationary.

Referring now to FIG. 3B, the panels 22, 24 are now shown in their expanded positions and extending at the smallest width of the object 20. In this position, the right side edge 26*c* of the panel 22 and the left side edge 26*a* of the panel 24 are offset from each other and the fabric material 34 of the panels 22, 24 adjacent the side edges 26*c*, 26*a*, respectively, overlap each other. When in this position, the loops 50 of panel 24 are adjacent the innermost end 46 of the straps 44 of panel 22. In addition, as shown in FIG. 1 and in phantom in FIG. 3B, the panel 24 may still be folded or pivoted about the hinge (see arrow A3) defined by the adjustable attachment mechanisms (i.e., loops 50 and straps 44) to be placed on top of the panel 22 to form a stack of two panels 22, 24. In this regard, it will be appreciated that the width or length of the panels 22, 24 can be varied.

Those skilled in the art will appreciate that the width of the object 20 can be varied by varying the length of the straps 44, thereby providing a wider distance for adjusting the relative positions of the two panels 22, 24. In this regard, the object 20 is well-suited for use as a sunshield for an automobile windscreen, since the width of the object 20 can be adjusted to fit a windscreen of virtually any width. However, as illustrated hereinbelow, the object 20 is not so limited in its application and utility, and has great utility for use in other applications.

Figure 4:
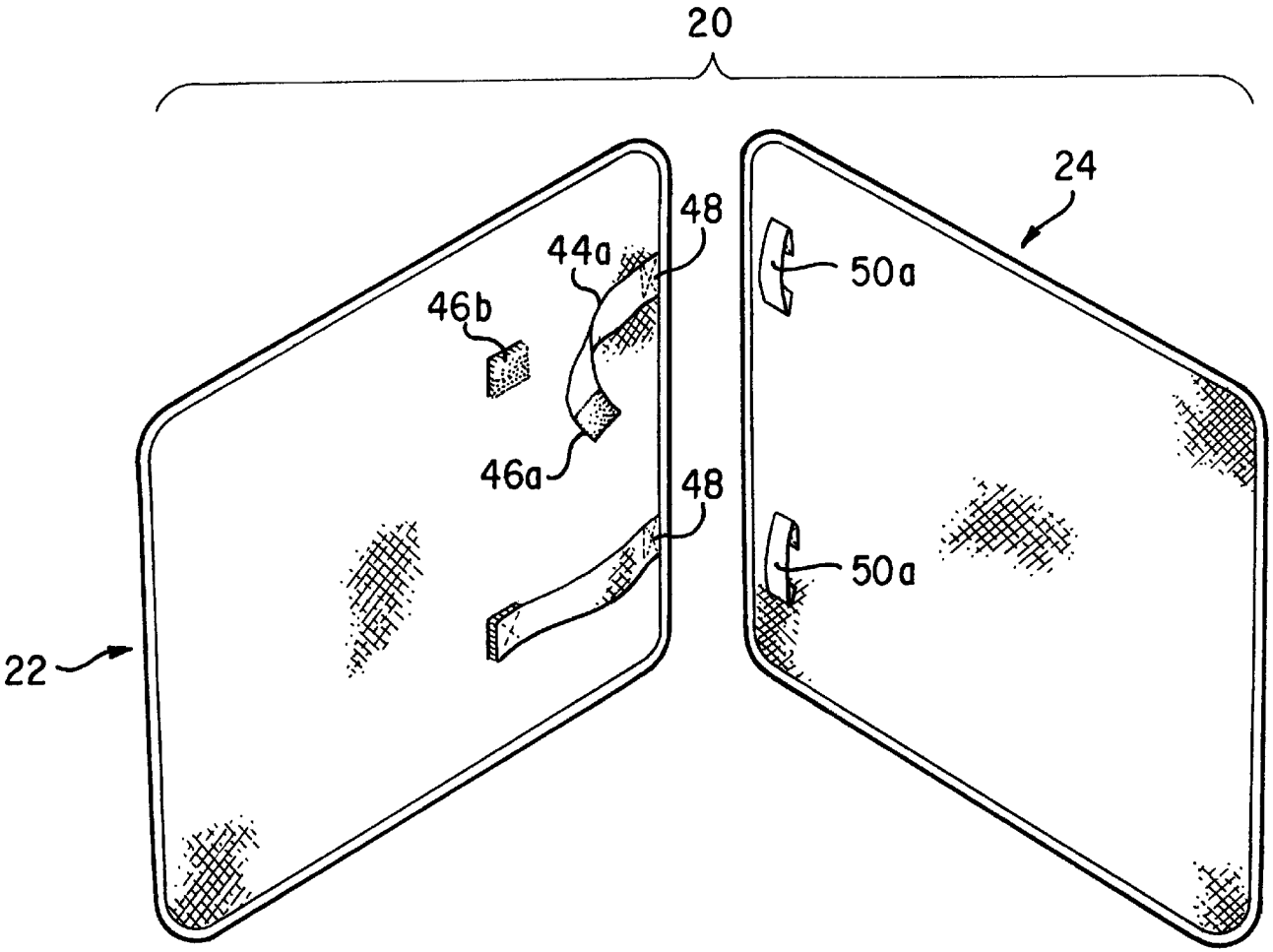
FIG. 4 is an exploded perspective view of the object of FIG. 1 illustrating a modification made thereto.

FIG. 4 illustrates a modification that can be made to the object 20 of FIG. 1. Instead of providing straps 44 that are permanently attached (e.g., by stitching) to the fabric material 34, the straps 44*a* in FIG. 4 can have one end (e.g., outermost end 48) permanently attached (e.g., by stitching) to the fabric material 34, while the other end 46*a* is free so that the two panels 22, 24 can be separated. The free end 46*a* can have a removable attachment mechanism (e.g., VELCRO™, hooks, and the like) provided thereat for engaging an opposing mechanism 46*b* (e.g., the opposing VELCRO™ pad, hook, or the like) provided on the fabric material 34. Each free end 46*a* can be inserted through its corresponding loop 50*a* on panel 24, and then secured to the opposing mechanism 46*b*. When secured, the straps 44*a* and their corresponding loops 50*a* operate in the same manner as illustrated in connection with FIG. 1. Loop 50*a* can be the same as loop 50 of FIG. 1, or it can even be a shorter-length strap 50*a* as shown in FIG. 4.

As a further alternative, both ends 46 and 48 of the straps 44 can be free ends having removable attachment mechanisms provided thereat.

Figure 5A:
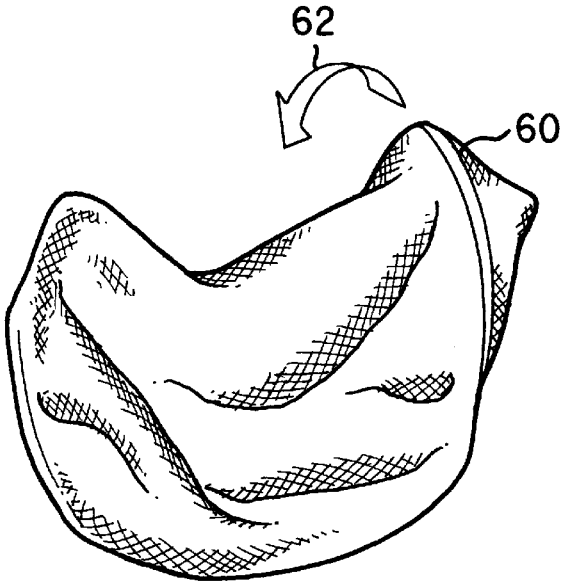
FIGS. 5A through 5D illustrate how the object of FIG. 1 may be twisted and folded for compact storage.
Figure 5B:
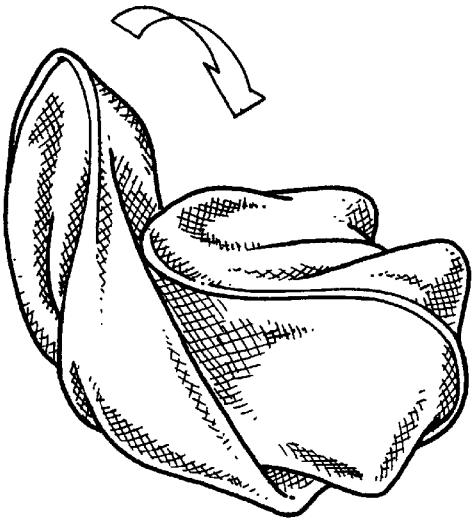
Figure 5C:
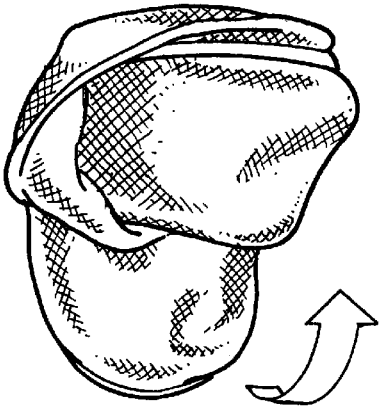
Figure 5D:
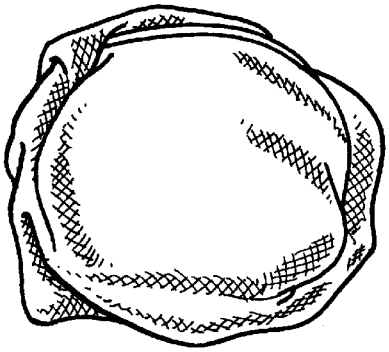

The object 20 can also be folded and collapsed into a compact configuration for storage, as illustrated in FIGS. 5A–5D. First, one panel (such as 24) is folded about the hinge defined by the adjustable attachment mechanisms (i.e., loops 50 and straps 44) to be placed on top of the other panel (such as 22) to form a stack of two panels 22, 24. Then, as shown in FIG. 5A, the opposite border 60 of the combined stack of panels 22, 24 is folded in (see arrow 62) to collapse the panels 22, 24. As shown in FIG. 5B, the collapsing is continued so that the initial size of the object 20 is reduced. FIG. 5C shows the next step, in which the panels 22, 24 are collapsed on each other to provide for a small essentially compact configuration having a plurality of concentric frame members 32 and layers of the fabric material 34 so that the collapsed object 20 has a size which is a fraction of the size of the initial object 20, as shown in FIG. 5D. Thus, the object 20 can be folded and stored very quickly using the steps illustrated in FIGS. 5A–5D.

To re-open the object 20 to its expanded configuration, the collapsed panels 22, 24 are unfolded. The memory (i.e., spring-load) of the frame members 32 will cause the frame members 32 to uncoil on their own and quickly expand the panels 22, 24 to the expanded configuration shown in FIG. 1. One panel 22, 24 can then be pivoted or opened with respect to the other panel 24, 22.

Figure 6:
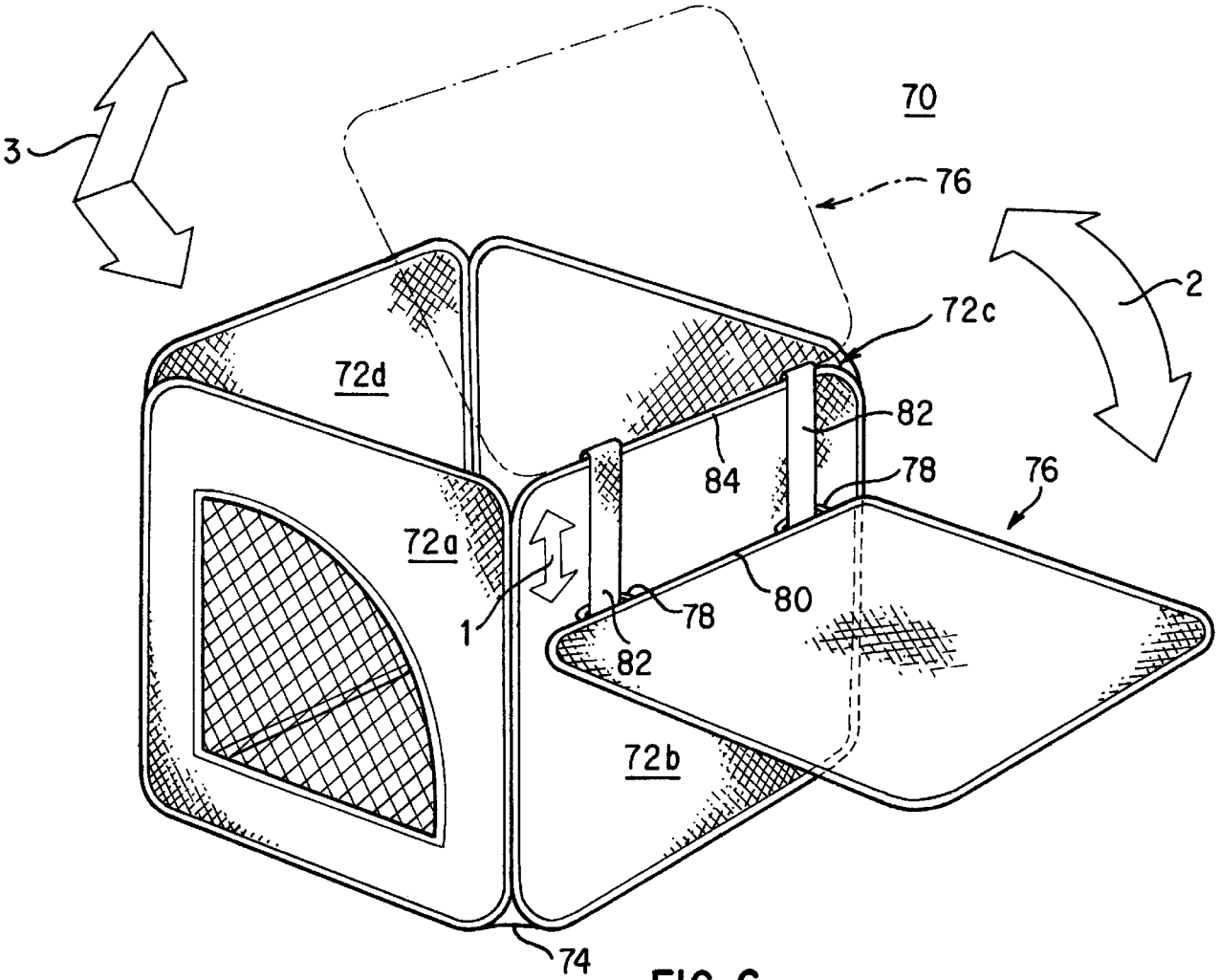
FIG. 6 is a perspective view of a collapsible structure according to another embodiment of the present invention adopting the principles of the object of FIG. 1 and shown in use in its expanded configuration.

FIG. 6 illustrates a second embodiment of the present invention, in which the principles of the present invention are utilized to provide added utility to a collapsible structure 70. The collapsible structure 70 has four panels 72*a*, 72*b*, 72*c* and 72*d* that are hingedly connected together to form an enclosed space. The structure of each panel 72*a*, 72*b*, 72*c* and 72*d* can be the same as the panels 22, 24 described above, and the panels 72*a*, 72*b*, 72*c* and 72*d* can be hingedly connected together according to the structures and techniques illustrated in connection with FIGS. 1, 1A, 2A and 2B of U.S. Pat. No. 5,560,385 (Zheng), entitled "Collapsible Play Structures", which is co-owned by the assignee of the present invention, and whose entire disclosure is incorporated by this reference as though fully set forth herein. A piece of fabric 74 may be stitched to the bottom sides of the panels 72*a*, 72*b*, 72*c* and 72*d* to form a floor or base.

In addition to the four panels 72*a*, 72*b*, 72*c* and 72*d*, the structure 70 also includes a top panel 76. Top panel 76 can have the same structure as panel 24 of FIG. 1, in which a pair of loops 78 are provided along a side edge 80 of the panel 76. A corresponding pair of straps 82 are provided on panel 72*b* adjacent a top edge 84 thereof, with these straps 82 inserted through the loops 78 to create an adjustable attachment mechanism similar to that described above. Thus, as illustrated in phantom in FIG. 6, the top panel 76 can be used as a lid to cover the top opening of the space defined by the four panels 72*a*, 72*b*, 72*c* and 72*d*. The top panel 76 can also be pivoted or folded about the top edge 84 of the panel 72*b* and then folded against the panel 72*b*, or slid downwardly along the straps 82 (as shown in FIG. 6). The structure 70 can be folded and collapsed, and re-opened, according to the principles set forth above and in U.S. Pat. No. 5,560,385 (Zheng). The structure 70 is especially well-suited for use as a play structure where a child can climb into the structure 70, or as a container (such as a laundry hamper), or as a container for holding sporting goods (e.g., basketballs or baseballs), among other applications.

Figure 7:
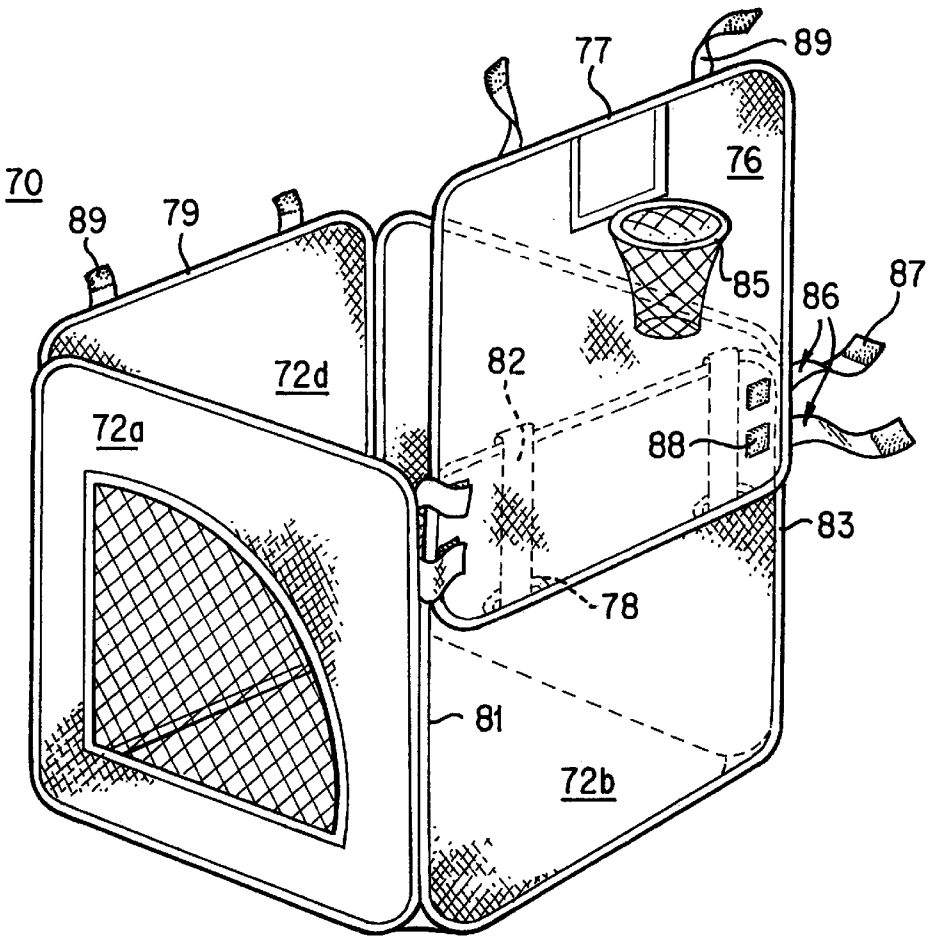
FIG. 7 is a perspective view of the object of FIG. 6 illustrating modifications made thereto.

FIG. 7 illustrates two additional features that can be provided to the structure 70. While the structure 70 was shown in FIG. 6 in use as a container or play structure, the structure 70 is shown in FIG. 7 in use as an amusement structure. In this regard, a basket 85 can be secured or otherwise attached to either the inner side or the outer side of the fabric of the top panel 76. In addition, locking mechanisms can be provided along the side edges 81 and 83 of the panel 72*b* to lock the panel 76 at a predetermined vertical position. Specifically, when the loops 78 of the panel 76 have been slid to their lowest vertical position adjacent the lower end of the straps 82, as shown in FIG. 7, the locking mechanisms can be deployed to secure the panel 76 in this vertical position. In this position, the basket 85 will be positioned at a desired height to allow the panel 76 to be used as a backboard for a ball-tossing amusement game, where balls can be tossed at the basket 85. One or more baskets 85 can be positioned on either side, or both sides, of the panel 76 to achieve the desired amusement effects.

Each locking mechanism can be a strap 86 having one end secured to a side edge 81 or 83 of panel 72*b*, and an opposing end having first connection mechanism 87 (e.g., a VELCRO™ pad, hook, or other similar connection mechanism) attached thereto. An opposing VELCRO™ pad, hook, or other similar connection mechanism 88 can be attached to any convenient location on the panel 76 for convenient engagement with the first connection mechanism 87. Similar locking mechanisms 89 can be provided along the top edge 77 of the top panel 76 and the top edge 79 of the panel 72*d* to secure the top panel 76 to the top edges of the panels 72*a*–72*d*. Thus, the structure 70 shown in FIG. 7 can be used both as an amusement structure and as a container.

Figure 8:
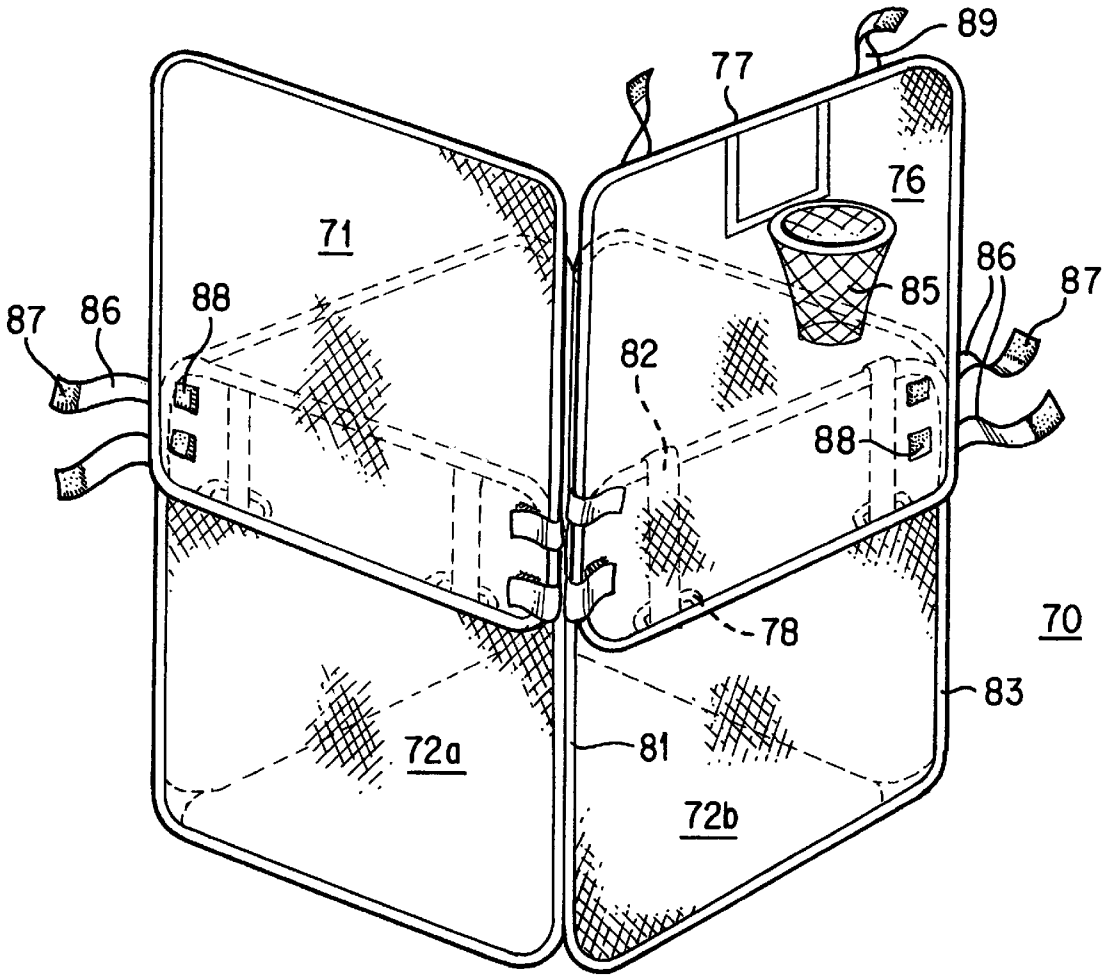
FIG. 8 is a perspective view of the object of FIG. 7 illustrating modifications made thereto.

FIG. 8 illustrates the structure 70 of FIGS. 6 and 7, but with an additional panel 71 that is coupled or attached to the panel 72*a* using the adjustable attachment mechanisms described above. In addition, locking mechanisms (such as straps 86 and connection mechanisms 87 described above) can also be provided to secure the vertical position of the panel 71. The structure 70 illustrated in FIG. 8 allows the panel 71 to be used as a top cover to the space enclosed by the panels 72*a*–72*d*, while the top panel 76 is being used as a backboard for an amusement game. Thus, the structure 70 illustrated in FIG. 8 can be simultaneously used as both a container and an amusement game.

Figure 9A:
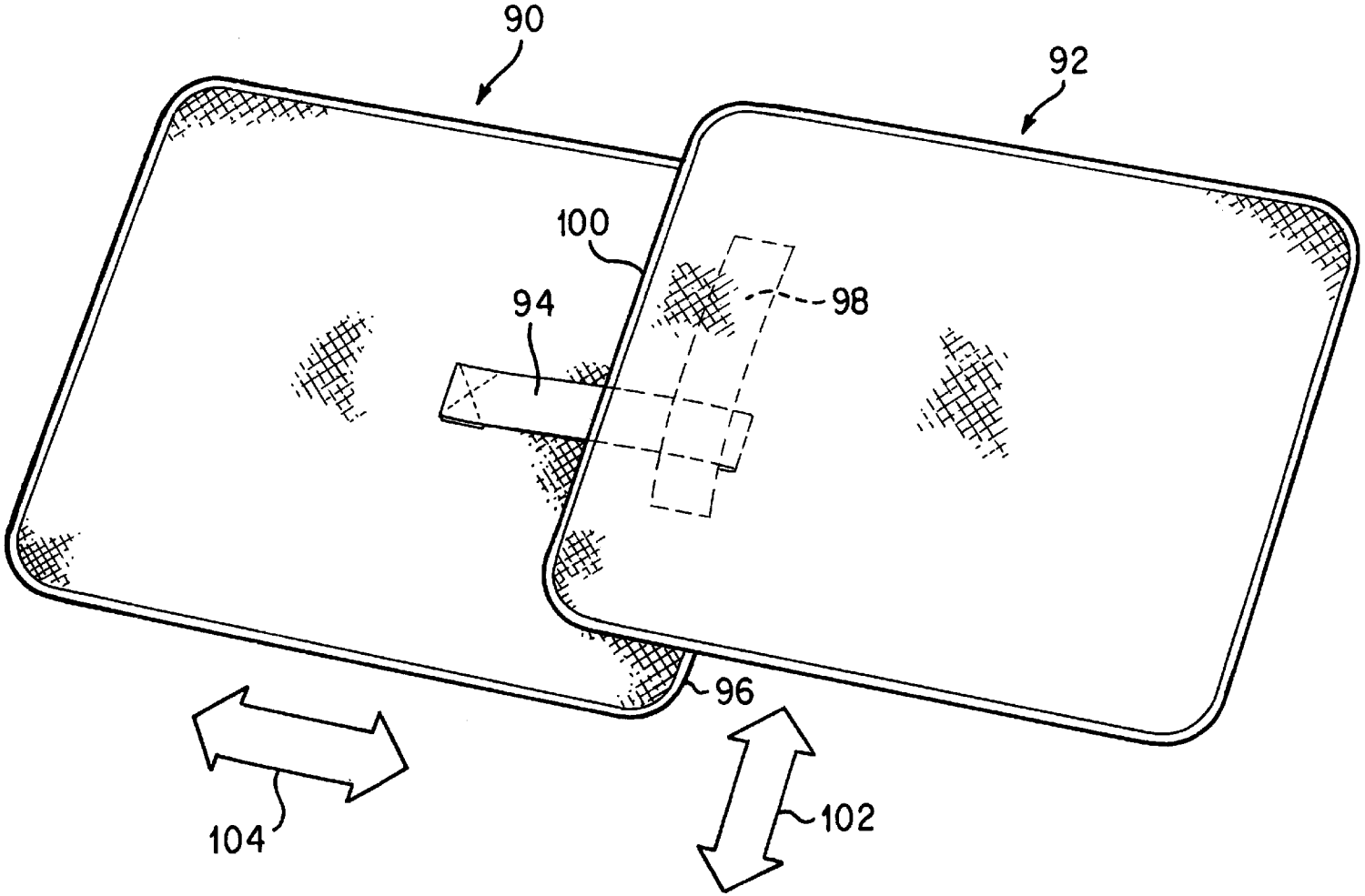
FIGS. 9A and 9B provide perspective views of a collapsible object according to a further embodiment of the present invention shown in use in its expanded configuration.

The principles of the present invention can be further modified to allow the two adjacent panels to slide vertically and horizontally with respect to each other. In FIG. 9A, two panels 90 and 92 are provided. Panel 90 can be the same as panel 22 of FIG. 1, except that only one elongated strap 94 is provided on the fabric material adjacent a right side edge 96. Panel 92 can be similar to panel 24 of FIG. 1, except that, instead of loops, an elongated strap 98 (shown in phantom), which is adapted to be positioned perpendicular to the strap 94, can be provided on the fabric material adjacent a left side edge 100. The two straps 94, 98 can be the same (and even have the same length, if desired), and are intertwined within each other so that the panels 90, 92 can be slid with respect to each other in both the vertical and horizontal directions. In other words, each strap 94, 98 is partially retained inside the adjustment space of the other strap, and each strap 94, 98 is slidable with respect to the other strap. For example, the panel 90 can be held stationary and the panel 92 slid vertically up or down (see arrow 102) with the strap 94 sliding within the space defined by the strap 98. This can also be achieved by holding panel 92 stationary and sliding panel 90 vertically up or down (see arrow 102). As yet another alternative, both panels 90, 92 can be slid simultaneously.

Similarly, the panel 92 can be held stationary and the panel 90 slid horizontally left or right (see arrow 104) with the strap 98 sliding within the space defined by the strap 94. This can also be achieved by holding panel 90 stationary and sliding panel 92 horizontally left or right (see arrow 104). Also, as mentioned above, both panels 90, 92 can be slid simultaneously.

The panels 90 and 92 can be folded and collapsed, and subsequently re-opened, using the principles described above in FIGS. 5A–5D.

Figure 9B:
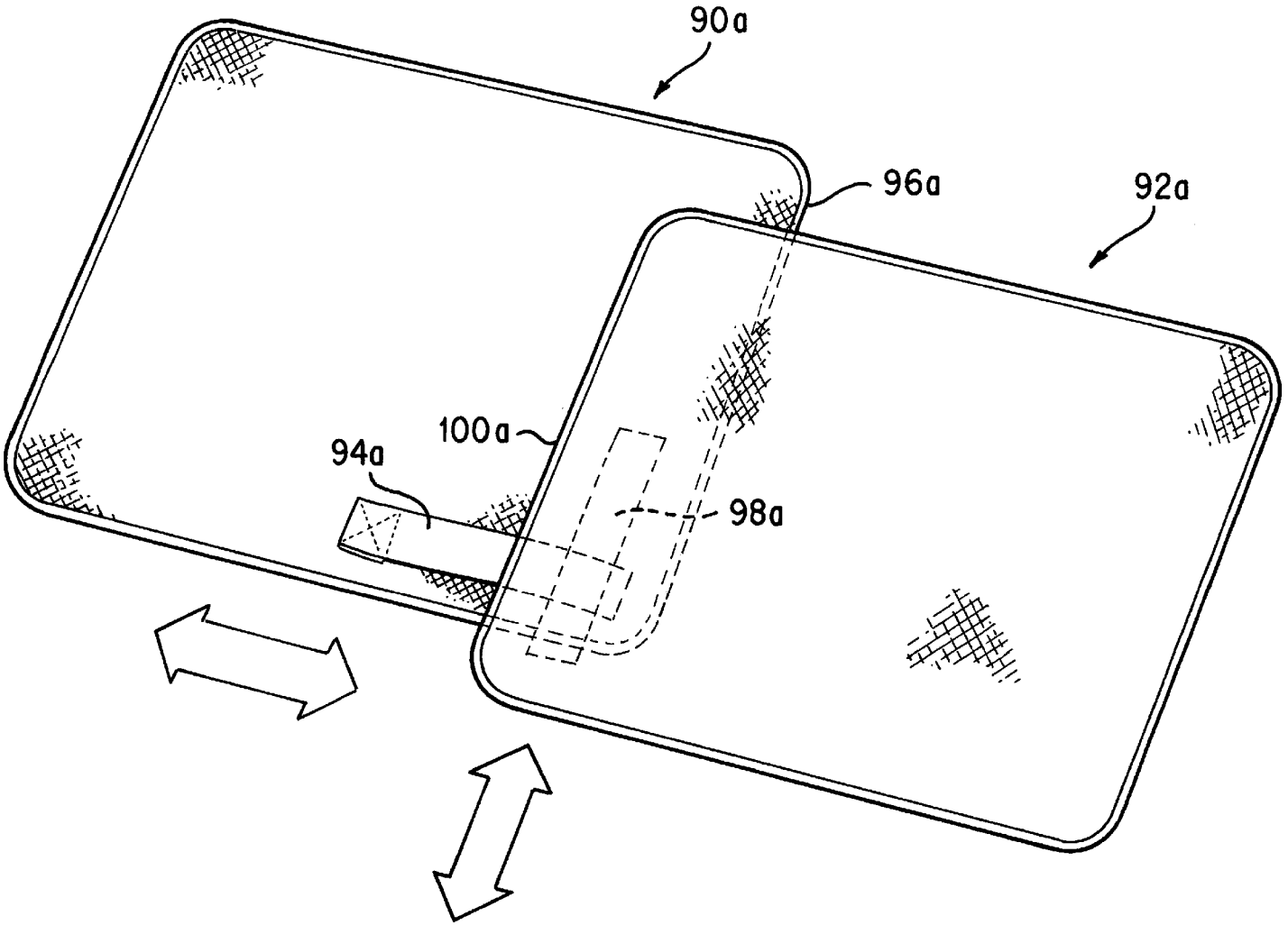

FIG. 9B illustrates a modification made to the panels 90 and 92 of FIG. 9A, in which the positions of the straps 94 and 98 on the panels 90 and 92, respectively, are changed. In FIG. 9B, the straps 94*a* and 98*a* have been lowered into corners of the panels 90*a* and 92*a*, respectively, along the same side edges 96*a* and 100*a*, respectively.

Figure 10:
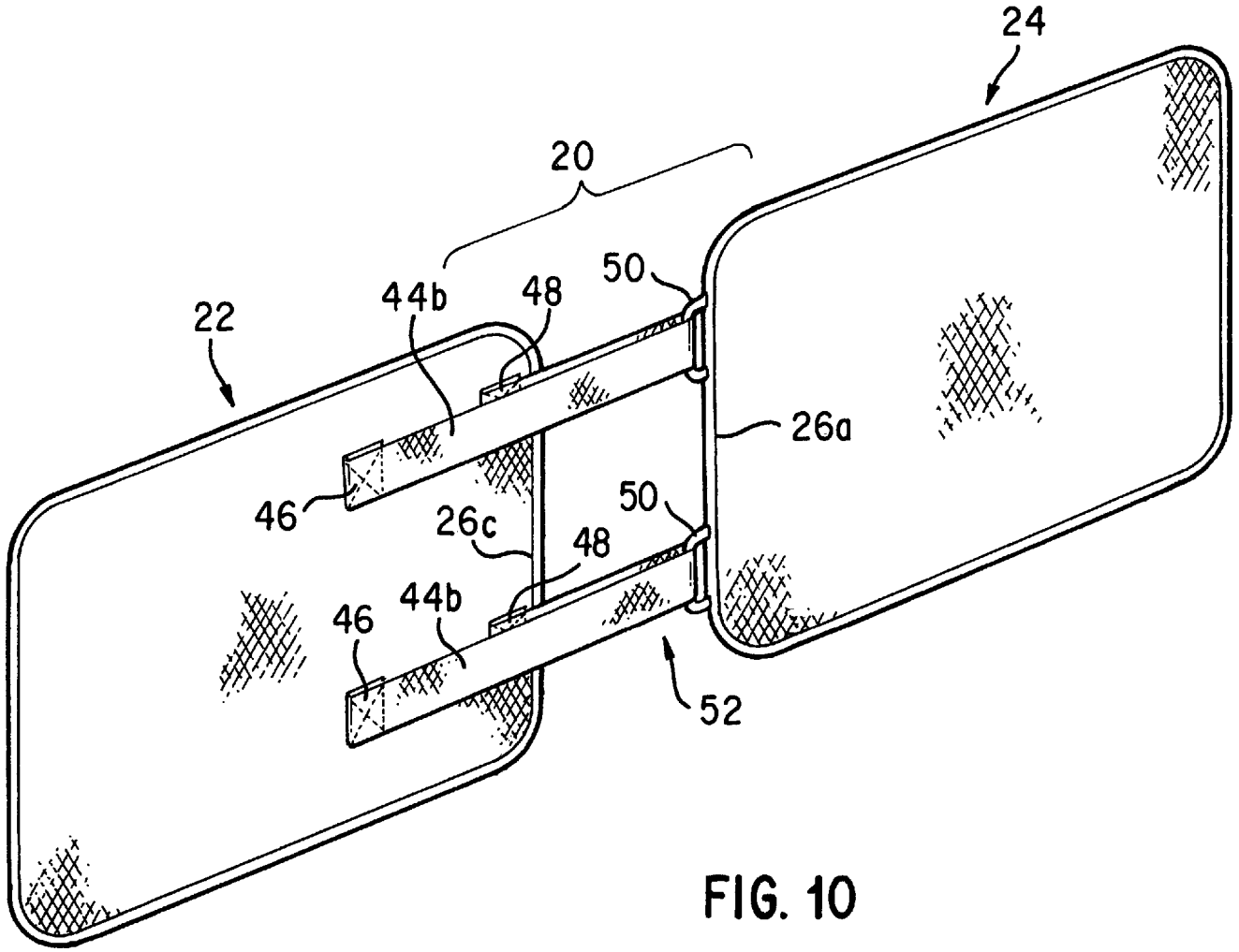
FIG. 10 is an exploded perspective view of the object of FIG. 1 illustrating another modification made thereto.

FIG. 10 illustrates a simple modification to the object 20 of FIG. 1, in which the strap 44*b* is made to be longer, and to define a greater slack or adjustment space between its ends 46 and 48. Thus, the width of the object 20 can be even increased beyond the maximum width illustrated in FIG. 3A. In FIG. 10, a gap or space 52 will be defined between the right side edge 26*c* of panel 22 and the left side edge 26*a* of panel 24 when the panels 22 and 24 are stretched apart to attain their maximum width.

In addition to the modifications described above, it is possible to provide all the straps 44*a* and 50*a* in FIG. 4, and 94 and 98 in FIGS. 9A and 9B, with at least one free end. The lengths of the straps in the various embodiments can be varied. In addition, the object can include more than two panels, with each panel coupled to other panels by adjustable attachment mechanisms or other attachment mechanisms.

Yet other features may be provided to the object 20. For example, referring back to FIG. 1, toggles 54 can be provided on the panel 22 and adapted to fit inside receiving loops 56 on the panel 24 to maintain the relative positions of the two panels 22, 24. Two sets of receiving loops 56*a* and 56*b* are provided on the panel 24. Depending on the desired overall width of the object 20 (see FIGS. 3A and 3B), the toggles 54 can be inserted into one or the other of the two sets of receiving loops 56*a* and 56*b*.

Figure 11A:
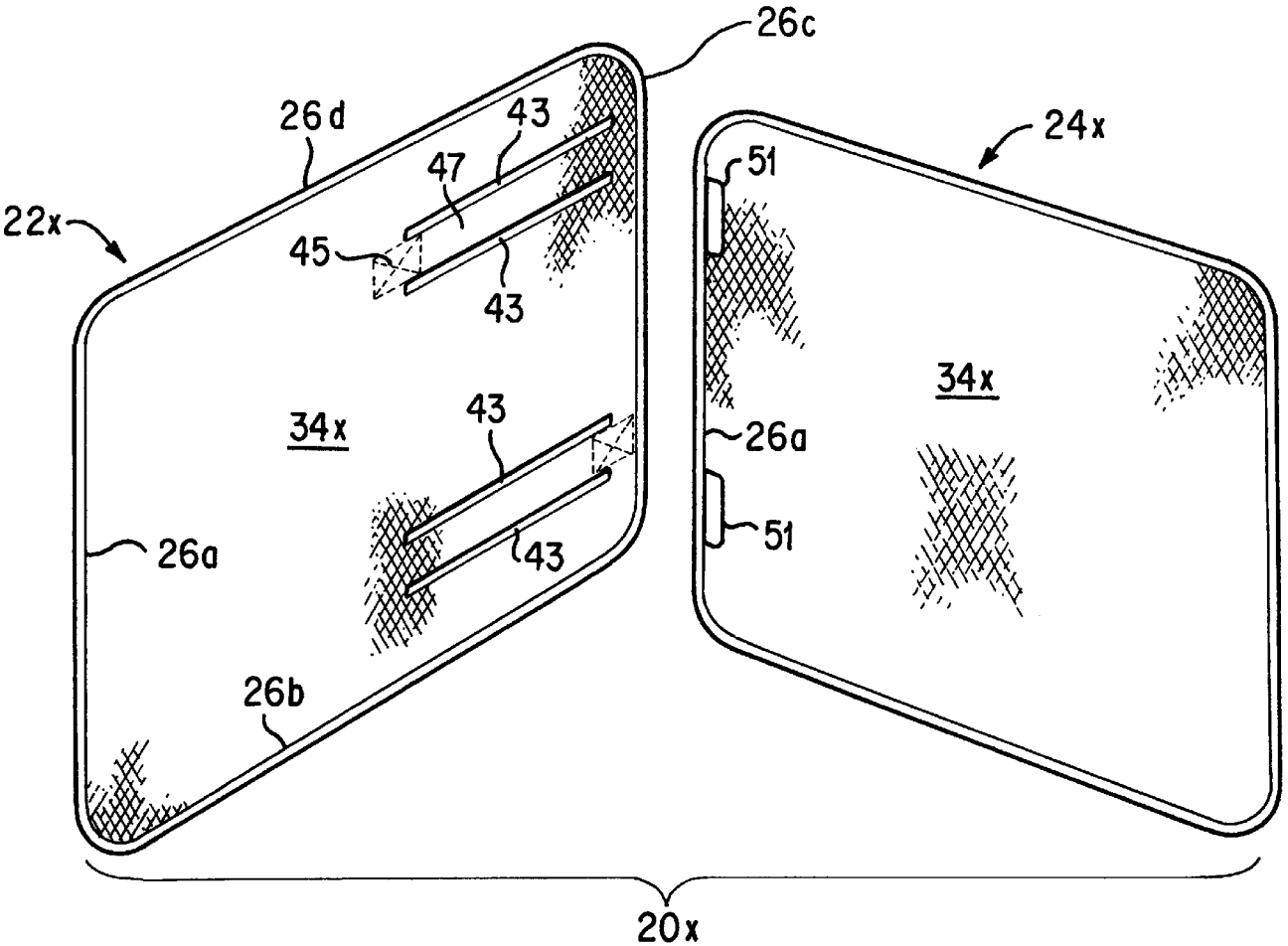
FIG. 11A is an exploded perspective views of a collapsible object according to yet a further embodiment of the present invention shown in use in its expanded configuration.

As a further example, the loops 50 and straps 44 in FIG. 1 can be omitted and replaced by elongated openings or holes provided in the fabric material 34 of panels 22, 24 adjacent the right side edge 26*c* and left side edge 26*a*, respectively of panels 22 and 24, respectively. This is illustrated in greater detail in FIGS. 11A and 11B, where, in the structure 20*x*, each strap 44 is replaced by a pair of generally parallel elongated openings or slits 43 that are created by cutting from the fabric 34*x* of the panel 22*x*, and each loop 50 is replaced by an opening 51 that is created by cutting from the fabric 34*x* of the panel 24*x*.

Figure 11B:
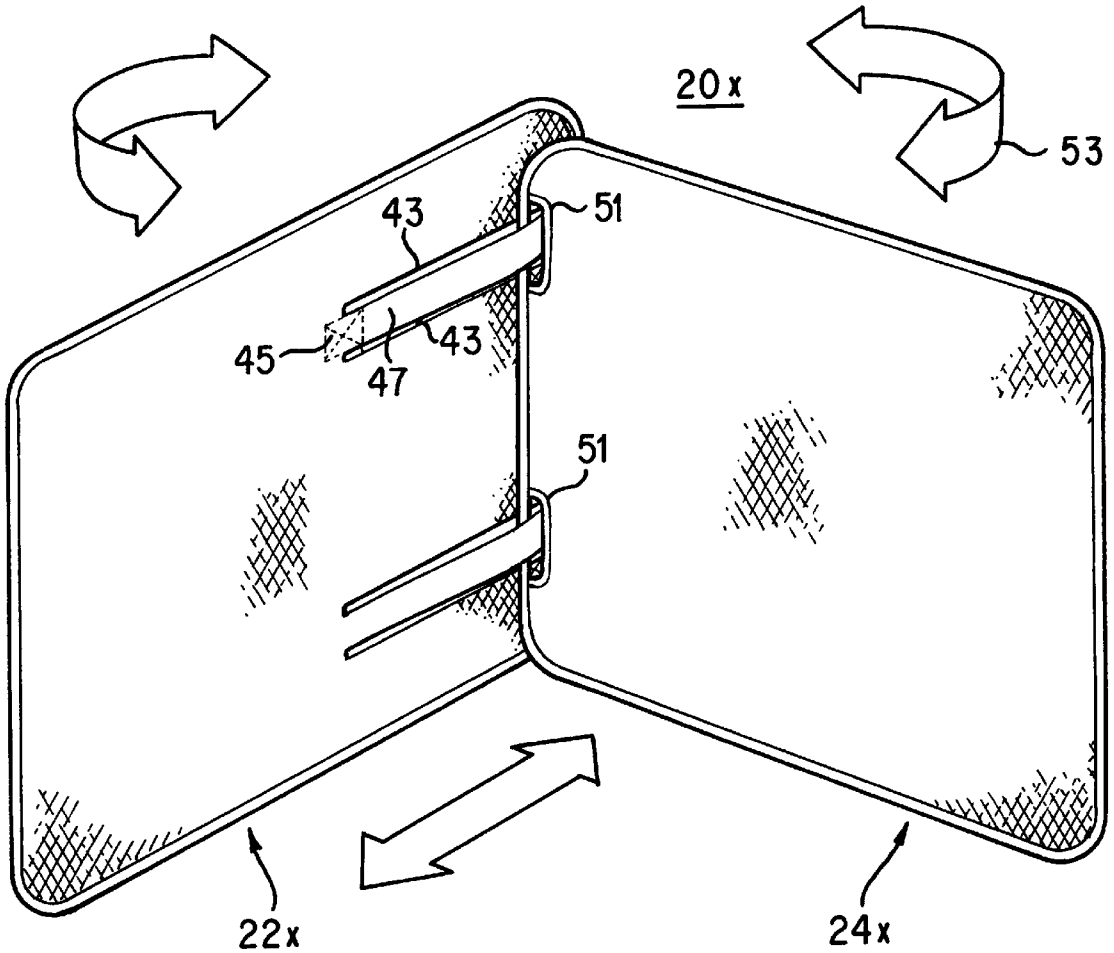
FIG. 11B is a perspective view of the object of FIG. 11A shown assembled together.

The panels 22*x*, 24*x* may be assembled in the following manner. First, the slits 43 are cut in the fabric 34*x* of the panel 22*x*. The region (such as 45) adjacent one end of a pair of slits 43 is cut so that the fabric between the pair of slits 43 becomes a strip 47 of fabric having a free end thereat. The free end of the strip 47 is then passed through the corresponding opening 51, and then the region 45 stitched or otherwise reattached to the fabric 34*x* to secure the strip 47 within the opening 51, as shown in FIG. 11B. When so secured, the opening 51 and the side edge 26*a* of the panel 24*x* can slide along the slits 43 within the length defined by the two ends of the strip 47. This can be done to attach all corresponding openings 51 and pairs of slits 43.

The openings 51 can be provided adjacent the left side edge 26*a* of the panel 24*x*, and the slits 43 can be cut from adjacent the right side edge 26*c* of the panel 22*x*, extending generally parallel relative to the top and bottom side edges 26*d* and 26*b*. The width of the strip 47 is preferably smaller than the size of the opening 51. Thus, the structure 20*x* operates in a similar manner as the structure 20, with the opening 51 sliding along the path or track created by the corresponding pair of slits 43 to adjust position of the panels 22*x*, 24*x* relative to each other. In this regard, the slits 43, and in particular the length of the slits 43 (the length of the slits 43 being defined by their opposing ends), define an adjustment space for sliding the opening 51 and side edge 26*a* of the panel 24*x*. The side edge 26*a* of the panel 24*x* can be made up of the frame retaining sleeve 30 and frame member 32 of the panel 24*x*.

Thus, the present invention provides collapsible objects and structures having at least two panels that have interacting and corresponding adjustable attachment mechanisms that function both to couple the panels to each other, and to allow relative positions of the panels to be adjusted to change the size and configuration of the object or structure. This increases the number of applications in which the collapsible objects and structures can be used, and adds to the fun and variety of these objects and structures.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An collapsible structure, comprising:

a first panel having a foldable frame member that has a folded and an unfolded orientation, and a material covering portions of the frame member when the frame member is in the unfolded orientation, with the material assuming the unfolded orientation of its associated frame member, the first panel having a first retaining mechanism that defines an adjustment space; and a second panel having a foldable frame member that has a folded and an unfolded orientation, and a material covering portions of the frame member when the frame member is in the unfolded orientation, with the material assuming the unfolded orientation of its associated frame member, the second panel having a second retaining mechanism that is movably received inside the adjustment space of the first retaining mechanism to couple the second panel to the first panel, with the second retaining mechanism movable within the adjustment space to allow the relative positions of the first and second panels to be adjusted.

2. The collapsible structure of claim 1, wherein the first panel has a first side edge, with the first retaining mechanism provided adjacent the first side edge, and wherein the second panel has a second side edge, with the second retaining mechanism provided adjacent the second side edge, wherein the first and second panels are pivoted about the first and second side edges, respectively.

3. The collapsible structure of claim 1, wherein the first retaining mechanism comprises a pair of elongated spaced-apart slits on the material, each having opposing first and second ends and between which is defined a strip of the material, and the second retaining mechanism comprises an opening through which the strip is inserted so that the opening can slide from the first end of the slits to the second end of the slits.

4. The collapsible structure of claim 1, wherein each panel further includes a frame retaining sleeve provided along the fabric for retaining the respective frame member.

5. The collapsible structure of claim 1, wherein the first retaining mechanism comprises a first elongated strap having opposing first and second ends attached to the first panel at spaced apart locations thereof to define the adjustment space between the first strap and the first panel, and the second retaining mechanism comprises a second elongated strap having opposing first and second ends attached to the second panel at spaced apart locations thereof, wherein the second strap is positioned generally perpendicular to the first strap and a portion of the second strap is retained inside the adjustment space of the first strap.

6. The collapsible structure of claim 5, wherein the second strap defines an adjustment space between the second strap and the second panel, and wherein a portion of the first strap is retained inside the adjustment space of the second strap.

7. The collapsible structure of claim 1, further including:

third, fourth and fifth panels, each of the third, fourth and fifth panels having a foldable frame member that has a folded and an unfolded orientation, and a material covering portions of the frame member when the frame member is in the unfolded orientation, with the material assuming the unfolded orientation of its associated frame member; and wherein the first, third, fourth and fifth panels each has a first side edge and a second side edge, with the first side edge of each of the first, third, fourth and fifth panels hingedly attached to the second side edge of an adjacent panel to define an enclosed space.

8. The collapsible structure of claim 7, wherein the fifth panel further includes a third retaining mechanism that defines a second adjustment space, the collapsible structure further including:

a sixth panel having a foldable frame member that has a folded and an unfolded orientation, and a material covering portions of the frame member when the frame member is in the unfolded orientation, with the material assuming the unfolded orientation of its associated frame member, the sixth panel having a fourth retaining mechanism that is movably received inside the second adjustment space of the third retaining mechanism to couple the sixth panel to the fifth panel, with the fourth retaining mechanism movable within the second adjustment space to allow the relative positions of the fifth and sixth panels to be adjusted.

9. The collapsible structure of claim 1, further including a locking mechanism for securing the relative positions of the first and second panels.

10. The collapsible structure of claim 9, wherein the locking mechanism has a first component coupled to the first panel, and a second component coupled to the second panel, with the first and second components being removably coupled to secure the relative positions of the first and second panels.

11. The collapsible structure of claim 1, wherein the first retaining mechanism comprises an elongated strap having opposing first and second ends attached to the first panel at spaced apart locations thereof, and the second retaining mechanism comprises a loop through which the strap is inserted so that part of the loop lies in the adjustment space, and so that the loop can slide from the first end of the strap to the second end of the strap.

12. The collapsible structure of claim 11, wherein the object has a width, and wherein the width of the collapsible structure is greatest when the loop is positioned adjacent the first end of the strap, and the width of the collapsible structure is smallest when the loop is positioned adjacent the second end of the strap.

13. The collapsible structure of claim 12, wherein a gap is defined between the first and second panels when the loop is positioned adjacent the first end of the strap.

14. The collapsible structure of claim 11, wherein the first end of the strap is a free end, and has an attachment mechanism provided thereon for attachment to the first panel.

15. A method of adjusting a dimension of an collapsible structure, the collapsible structure having a first panel and a second panel, each panel having a foldable frame member that has a folded and an unfolded orientation, and a material covering portions of the frame member when the frame member is in the unfolded orientation, with the material assuming the unfolded orientation of its associated frame member, the first panel further including a first retaining mechanism that defines an adjustment space, and the second panel further including a second retaining mechanism, comprising:

a. movably receiving the second retaining mechanism inside the adjustment space of the first retaining mechanism to couple the second panel to the first panel; and b. moving the second retaining mechanism within the adjustment space to adjust the relative positions of the first and second panels.

16. The method of claim 15, further including:

c. removing the second retaining mechanism from the adjustment space of the first retaining mechanism to separate the first and second panels.

* * * * *